United States Patent [19]

Pundyk

[11] 4,144,912

[45] Mar. 20, 1979

[54] BRASSIERE HAVING INDEPENDENTLY ADJUSTABLE BREAST CUPS

[75] Inventor: Bernard Pundyk, South Orange, N.J.

[73] Assignee: Glamorise Foundations, Inc., New York, N.Y.

[21] Appl. No.: 861,439

[22] Filed: Dec. 16, 1977

[51] Int. Cl.[2] ..... A41C 3/00

[52] U.S. Cl. ..... 128/484

[58] Field of Search ..... 128/425, 443, 484, 492, 128/494, 498, 477, 478

[56] References Cited

U.S. PATENT DOCUMENTS

| | | | |
|---|---|---|---|
| 2,061,739 | 11/1936 | Rasch | 128/484 |
| 2,501,860 | 3/1950 | Becker | 128/484 |
| 2,508,708 | 5/1950 | Becker | 128/484 |
| 3,019,792 | 2/1962 | Kahn | 128/492 |
| 3,082,771 | 3/1963 | Bruno | 128/498 |
| 3,866,617 | 2/1975 | Gluckin | 128/484 |

*Primary Examiner*—Werner H. Schroeder
*Assistant Examiner*—Doris L. Troutman
*Attorney, Agent, or Firm*—Larson, Taylor and Hinds

[57] ABSTRACT

An improved brassiere comprises a pair of breast pockets each having a first, three-section, front panel and a second, elastomeric, front panel, and a separate inner panel at least partially overlapping both front panels. The inner edge of the rear panel is connected to the center seam of the brassiere by an elastic strap, and the lower edge of the rear panel is detached and spaced from the lower edges of the front panels.

15 Claims, 3 Drawing Figures

BRASSIERE HAVING INDEPENDENTLY ADJUSTABLE BREAST CUPS

FIELD OF THE INVENTION

The present invention generally relates to brassieres, and more particularly to brassieres having adjustable breast cups.

BACKGROUND OF THE INVENTION

A number of brassieres have been developed in the prior art which provide for adjustment of the size and the shape of the breast cups for various reasons, including adaptation to the individual wearer and to the changes in the size of female breasts which commonly and regularly occur. The most pertinent examples of adjustable breast cup prior art brassieres of which applicant is aware are disclosed in U.S. Pat. Nos. 2,061,739 (Rasch); 2,577,842 (Ciringione); 2,635,242 (Sands); and 2,911,975 (Verreault). It is to be noted in connection with the above listing that no representation is being made that no better art exists.

The Rasch patent discloses a self-adjusting brassiere having cup panels comprised of overlapping outer and inner supporting portions which are each extensible and each independently extensible with respect to each other. The rear supporting portion of each cup panel is fastened along the upper edge thereof to one half of the bottom edge of a cover piece, and along the inner edge thereof to the other inner portion along a center seam which continues to connect together the inner edges of the cover pieces. Further, the outer half of each inner supporting portion is cut out so as to taper to a narrow width outer end, which is attached, depending on the embodiment, either to a side panel by means of elastic, or to the other inner portion end by a separate elastic strap which girdles the wearer. Still further, the front supporting portion of each cup panel is cut out so as to taper to a narrow width inner end which is attached to the corresponding end of the other front supporting panel by an elastic insert. The outer edge of each front supporting panel is fastened directly to the corresponding side panel.

The Ciringione patent discloses a brassiere construction wherein the breast cup panels are provided with overlapping inner and outer portions to allow adjustment of the elevation of the breasts without lateral displacement thereof. The inner breast receiving pocket of each cup panel is directly fastened along its side and bottom edges to the side panel and the frontal portion of the body panel, respectively, and is fastened at the apex formed by the sloping upper edges to the corresponding shoulder strap by means of an elastic connection.

The Sands patent discloses a brassiere having an adaptable breast cup construction wherein the cup panels are formed from a single blank of material configured to provide overlapping inner and outer panel portions. The outer edges of the rear panels are connected to the side panels by elastic and the inner edges of the front panels are connected by elastic to the center seam such that a tensile force is provided which restrains upward movement of the panel portion.

The Verreault patent discloses a brassiere construction providing an adjustable uplifting support for the wearer's breasts and relatively free movement of portions of the breast pockets in response to body movements wherein the cup panels comprise multi-section outer panels and overlapping inner portions. The inner portions comprise two triangular sections defining an intermediate V-shaped notch. The upper ends of both the outer panel and inner portion are attached to the corresponding shoulder straps by a slidable tape, and the apices of each inner portion are connected to the slidable tape by two pieces of elastic.

The prior art suffers from a number of disadvantages, including complexity of manufacture, the requirement of special straps and the like which require manual adjustment in order to achieve a desired result, and/or a lack of fully independent cup adaptability.

SUMMARY OF THE INVENTION

These and other disadvantages of the prior art are overcome by a brassiere constructed in accordance with the present invention, wherein each breast cup comprises first and second front panels and a rear panel overlapping at least a portion of the front panels. The inner edge of the first front panel is connected to the center seam of the brassiere, and the second front panel, which is elastomeric, connects at least a portion of the outer edge of the first front panel to the corresponding side panel of the brassiere. The upper edge of the rear panel is connected to the first and second front panels, the outer edge of the rear panel is connected to the corresponding side panel, and the inner edge of the rear panel is connected to the center seam in spaced relationship thereto by an intermediate elastomeric strap. Preferably, the lower edge of the rear panel is detached from the front panels and is spaced from the bottom edges thereof so as to overlap an interior portion of the front panels.

In accordance with the invention, the first front panel may advantageously comprise a top section, a middle section and a bottom section. The inner edges of all three sections may be connected to the center seam, while the outer edge of the top section may be connected to the corresponding side panel, and the outer edges of the middle and bottom sections may be connected to the inner edge of the second front panel. Further, the lower edge of the top section preferably may be connected along a first portion thereof to the upper edge of the middle section and along a second portion thereof to the upper edge of the second front panel.

In accordance with a further aspect of the invention, the upper edge of the rear panel is connected to the first and second front panels along the seam defined by the upper edges of the first front panel middle section and the second front panel and the lower edge of the first front panel top section, which seam preferably has relatively linear end portions and a relatively arcuate, concave downward middle portion.

In accordance with a still further aspect of the invention, the intermediate strap is inclined relative to the center seam such that the strap end connected to the center seam is relatively higher than the strap end connected to the rear panel.

Other features and advantages of the invention will be set forth in, or apparent from, the detailed description of a preferred embodiment found hereinbelow.

BRIEF DESCRIPTION OF THE DRAWING

The novel features of the invention will be best understood from the following description when taken together with the accompanying drawing, in which.

DETAILED DESCRIPTION OF THE PREFERRED EMBODIMENT

Figure 1:
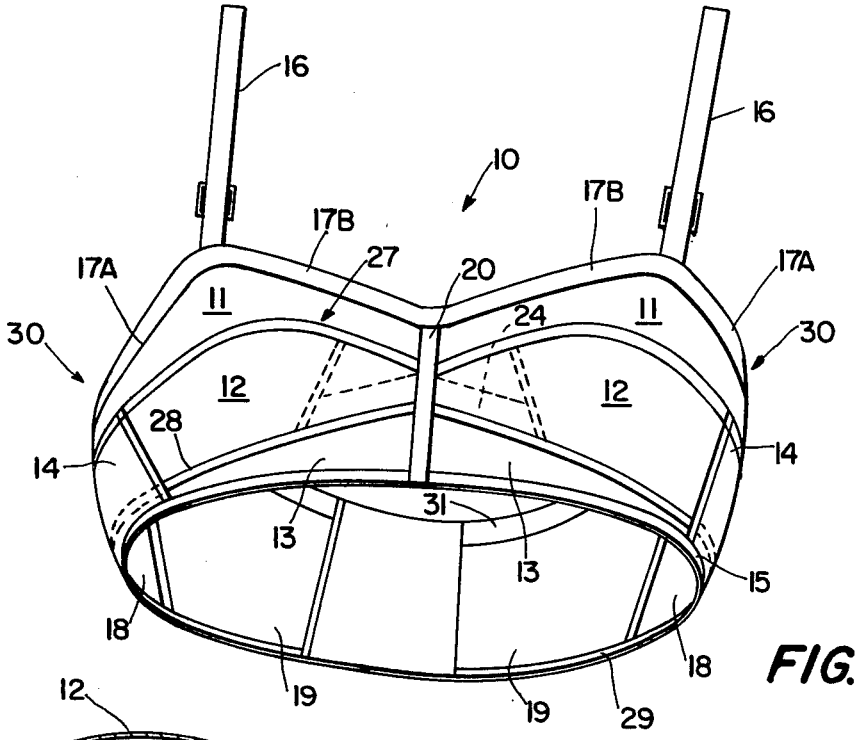
FIG. 1 is a front perspective view of a brassiere constructed in accordance with the invention.
Figure 3:
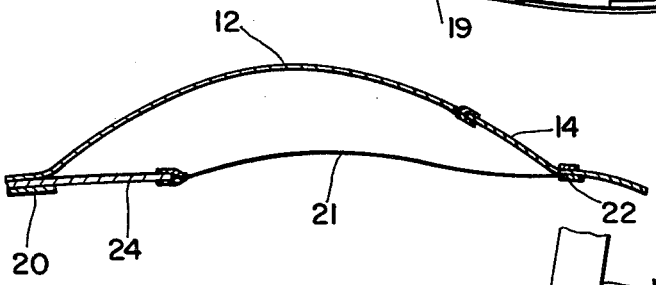
FIG. 3 is a sectional view taken along the line 3—3 in FIG. 2.
Figure 2:
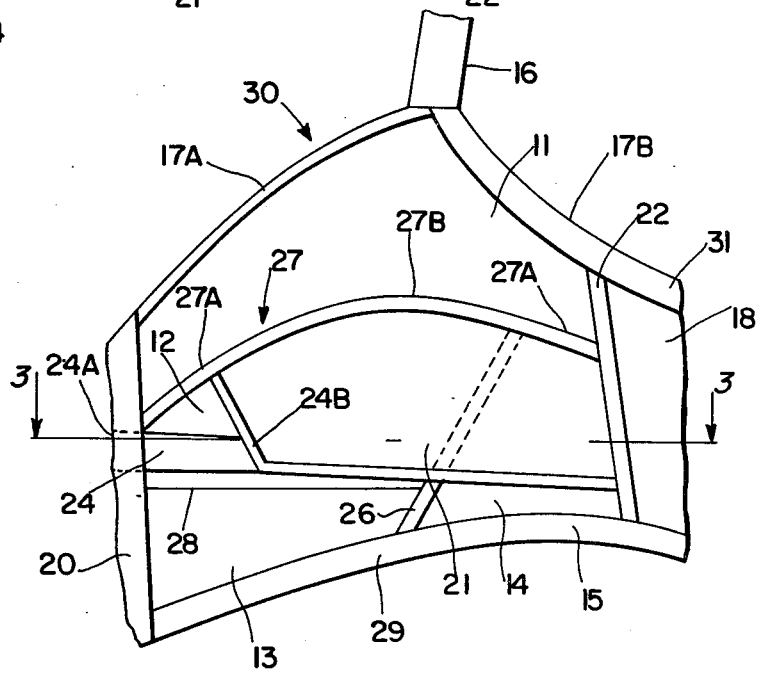
FIG. 2 is an enlarged elevational view of a portion of the brassiere illustrated in FIG. 1, showing the rear thereof.

Referring to the Figures, an improved brassiere constructed in accordance with the present invention will now be described. Conventionally, the brassiere, generally denoted 10, comprises a pair of breast cups, generally denoted 30, joined together along a center seam 20; a side panel 18 connected to each breast cup 30; a pair of shoulder straps 16 connected between breast cups 30 and side panels 18; and fastening elements (not shown) for releasably fastening the distal ends of side panels 18 together.

In accordance with the invention, each breast cup 30 comprises a first front panel, generally denoted 25, a second elastomeric front panel 14, and a rear panel 21 which overlaps a portion of both front panels 25 and 14.

Front panel 25 comprises a top section 11, a middle section 12, and a bottom section 13. Referring to top section 11, the inner edge thereof is connected to center seam 20, the outer edge thereof is connected to the inner edge of the corresponding side panel 18, the upper edge thereof constitutes the upper edge of breast cup 30, to which the corresponding shoulder strap 16 is connected, and the lower edge thereof is connected along a first portion to the upper edge of middle section 12 and along a second portion to the upper edge of front panel 14.

Referring to middle section 12, the inner edge thereof is connected to center seam 20, the outer edge thereof is connected to the inner edge of front panel 14, and the lower edge thereof is connected to the upper edge of bottom section 13.

Referring to bottom section 13, the inner edge thereof is connected to center seam 20 and the outer edge thereof is connected to the inner edge of front panel 14.

As shown, middle section 12 and top section 11 of front panel 25, and front panel 14 are configured such that the upper edges of middle section 12 and front panel 14, and the lower edge of top section 11, define a continuous seam 27 having relatively linear end portions 27A, and a relatively arcuate, concave downwardly directed, middle portion 27B. Further, middle section 12 and bottom section 13 of front panel 25 are configured such that the lower edge of middle section 12 and the upper edge of bottom section 13 define a substantially linear seam 28. Seam 28 and the end portion 27A of seam 27 which is adjacent to center seam 20 are preferably inclined with respect to each other so as to converge in the direction of center seam 20, but to be spaced apart at seam 20, as shown.

Front panel 14 is configured such that the inner edge thereof is inclined, with the upper end being relatively nearer to the outer edge of panel 14, and relatively further away from center seam 20, than the lower end.

Turning to rear panel 21, which advantageously may be made from a mesh-like material, the upper edge thereof is connected to front panels 25 and 14, preferably along seam 27, as shown; the outer edge thereof is connected to the inner edge of the corresponding side panel 18; and the inner edge thereof is connected to center seam 20 in spaced relationship thereto by an intermediate elastomeric strap 24. As shown, rear panel 21 is configured such that the inner edge thereof is inclined relative to center seam 20 with the upper end of the inner edge being relatively nearer to seam 20 than the lower end. Also, as shown, the lower edge of rear panel 21 is detached from front panels 25 and 14, and is spaced from the bottom edges thereof so as to overlap an interior portion of front panels 25 and 14. In addition, rear panel 21 is preferably configured, as shown, such that the lower edge thereof is inclined with respect to center seam 20 at substantially the same relative angle of inclination as seam 28.

Intermediate strap 24 is inclined relative to center seam 20 such that the end 24A of strap 24 which is connected to seam 20 is relatively higher than the end 24B which is connected to rear panel 21, thereby providing a tensile force which restrains relatively downward and outward movement of panel 21. Preferably, as shown, strap end 24A, is connected to seam 20 in overlapping alignment with the inner edge of front panel middle section 12 and has the same relative angle of inclination with respect to seam 20 as the lower edge of panel 21. Further, as shown, strap 24 may be connected to panel 21 such that the lower edges thereof are substantially colinear.

Brassiere 10 may also be provided, as shown, with an elastomeric bottom band 29 to which the lower edges of front panel 14 and front panel bottom section 13 are connected. In addition, the upper edge of brassiere 10, extending from the distal end of each side panel 18 to the location at which the corresponding shoulder strap 16 is connected to the upper edges of front panel top sections 11, may be defined by an elastomeric band 31. Thus, the portion 17A of the upper edge of front panel top section 11 is preferably axially stretchable, while the portion 17B is relatively unyielding.

With a brassiere constructed in accordance with the present invention, such as that described hereinabove, full and independent adjustment of each breast cup is automatically achieved without the necessity for the wearer to make any strap adjustments, or the like, in addition to those associated with conventional brassieres not having any provision for adjustment of the breast cups.

Although the invention has been described with respect to an exemplary embodiment thereof, it will be understood that variations and modifications can be effected in the embodiment without departing from the scope or spirit of the invention.

I claim:

1. In a brassiere having first and second breast cups joined together along a center seam, first and second side panels connected to said first and second breast cups, respectively, and first and second shoulder straps connected to said first and second breast cups, respectively, the improvement wherein each of said breast cups comprises a first front panel, the inner edge of said first front panel being connected to the center seam, a second elastomeric front panel connecting at least a portion of the outer edges of said first front panel to the corresponding side panel, and a rear panel overlapping at least a portion of said first and second front panels, the upper edge of said rear panel being connected to said first and second front panels, the outer edge of said rear panel being connected to the corresponding side panel, and the inner edge of said rear panel being connected to the center seam in spaced relationship thereto by an intermediate elastomeric strap.

2. The improved brassiere of claim 1 wherein the lower edge of said rear panel is detached from said front panels and is spaced from the bottom edges of said front panels so as to overlap an interior portion of said front panels.

3. The improved brassiere of claim 1 wherein said first front panel comprises a top section, a middle section, and a bottom section.

4. The improved brassiere of claim 3 wherein the inner edge of said top section is connected to the center seam, the lower edge of said top section is connected along a first portion thereof to the upper edge of said middle section and along a second portion thereof to the upper edge of said second panel, and the outer edge of said top section is connected to the corresponding side panel.

5. The improved brassiere of claim 4 wherein the inner edge of said middle section is connected to the center seam, the outer edge of said middle section is connected to the inner edge of said second front panel, and the lower edge of said middle section is connected to the upper edge of said bottom section.

6. The improved brassiere of claim 5 wherein the inner edge of said bottom section is connected to the center seam and the outer edge of said bottom section is connected to the inner edge of said second front panel.

7. The improved brassiere of claim 6 wherein the upper edges of said middle section and said second front panel and the lower edge of said top section define a first seam having relatively linear end portions and a relatively arcuate, concave downward middlé portion, and the upper edge of said rear panel is connected to said first seam.

8. The improved brassiere of claim 1 wherein said intermediate strap is inclined relative to the center seam such that the end of said intermediate strap connected to the center seam is relatively higher than the end of said intermediate strap connected to said rear panel.

9. The improved brassiere of claim 8 wherein the end of said intermediate strap connected to the center seam is in overlapping alignment with the inner edge of said front panel middle section.

10. The improved brassiere of claim 9 wherein the lower edge of said front panel middle section and the upper edge of said front panel bottom section define a substantially linear second seam, and said second seam and the end portion of said first seam adjacent the center seam are inclined with respect to each other so as to converge in the direction of the center seam.

11. The improved brassiere of claim 10 wherein the lower edge of said rear panel is inclined with respect to the center seam at substantially the same angle of inclination as said second seam.

12. The improved brassiere of claim 11 wherein the inner edge of said second front panel is inclined such that the upper end thereof is relatively nearer to the outer edge of said second front panel, and relatively further away from the center seam, than the lower end thereof.

13. The improved brassiere of claim 12 wherein the inner edge of said rear panel is inclined relative to the center seam such that the upper end of the inner edge is relatively nearer to the center seam than is the lower end.

14. The improved brassiere of claim 13 further comprising an elastomeric bottom band, the lower edges of said second front panel and said front panel bottom section being connected to said bottom band.

15. The improved brassiere of claim 14 further comprising an elastomeric top band extending from the distal end of each side panel to the location at which the corresponding shoulder strap is connected to the corresponding breast cup, the portion of the upper edge of said top section which extends from the location at which the corresponding shoulder strap is connected to the corresponding side panel being connected to said top band.

* * * * *